US008173938B2

(12) United States Patent
Robst

(10) Patent No.: US 8,173,938 B2
(45) Date of Patent: May 8, 2012

(54) CONTROLLER FOR A HEATING CABLE

(75) Inventor: Thomas Robst, Shipley (GB)

(73) Assignee: Thermocable (Flexible Elements) Limited (GB)

( * ) Notice: Subject to any disclaimer, the term of this patent is extended or adjusted under 35 U.S.C. 154(b) by 1121 days.

(21) Appl. No.: 11/794,694

(22) PCT Filed: Dec. 22, 2005

(86) PCT No.: PCT/GB2005/005020

§ 371 (c)(1),
(2), (4) Date: Nov. 13, 2007

(87) PCT Pub. No.: WO2006/072765

PCT Pub. Date: Jul. 13, 2006

(65) Prior Publication Data

US 2008/0251509 A1 Oct. 16, 2008

(30) Foreign Application Priority Data

Jan. 8, 2005 (GB) ..... 0500353.8

(51) Int. Cl.
*H05B 1/02* (2006.01)

(52) U.S. Cl. ..... 219/488; 219/497

(58) Field of Classification Search ..... 219/488, 219/489, 490, 497, 504, 505, 543–549
See application file for complete search history.

(56) References Cited

U.S. PATENT DOCUMENTS

| | | | | |
|---|---|---|---|---|
| 3,375,477 | A | 3/1968 | Toshinobu | |
| 4,546,238 | A | 10/1985 | Ahs | |
| 4,577,094 | A | 3/1986 | Milla et al. | |
| 5,081,341 | A | 1/1992 | Rowe et al. | |
| 5,262,609 | A * | 11/1993 | Nowak et al. | 219/109 |
| 6,310,332 | B1 | 10/2001 | Gerrard | |
| 6,958,463 | B1 * | 10/2005 | Kochman et al. | 219/544 |
| 2002/0114982 | A1 * | 8/2002 | Putt et al. | 429/3 |

FOREIGN PATENT DOCUMENTS

| | | | |
|---|---|---|---|
| GB | 1601126 | A | 10/1981 |
| GB | 2330463 | A | 4/1999 |
| WO | WO 2005/009080 | | 1/2005 |

* cited by examiner

*Primary Examiner* — Sang Paik
(74) *Attorney, Agent, or Firm* — Smyrski Law Group, A P.C.

(57) ABSTRACT

A controller for a heating cable. The heating cable includes first and second conductors and a separation layer interposed between the conductors. The conductors and the separation layer extend along the length of the cable and electrical resistance provided by the separation layer between adjacent portions of the conductors has a negative temperature coefficient. The controller includes a first switch, arranged for connecting the first and second conductors in series at one end of the cable such that if the first and second conductors are connected at the other end of the cable to respective poles of a power supply currents flow in opposite directions through adjacent portions of the conductors. The controller further includes a second switch and voltage measurement functionality. The controller is arranged to control power to the cable as a function of measured voltage across the first resistor when both switches are open.

24 Claims, 2 Drawing Sheets

CONTROLLER FOR A HEATING CABLE

CROSS-REFERENCE TO RELATED APPLICATIONS

The present application is a U.S. National Stage (37 U.S.C. §371) filing of PCT/GB2005/005020, filed Dec. 22, 2005, entitled "A Controller for a Heating Cable," inventor Thomas Robst, which claims priority based on Great Britain Patent Application 0500353.8, filed Jan. 8, 2005, entitled "A Controller," inventor Thomas Robst.

BACKGROUND OF THE INVENTION

1. Field of the Invention

The present invention relates to a controller for a heating cable. In particular, but not exclusively, the present invention relates to a controller arranged to control the flow of current to a heating cable in order to control the temperature of the heating cable.

2. Description of Related Art

Conventionally, a heating cable comprises a long assembly having at least one conductor extending along the length of the cable, and an insulation layer surrounding at least one conductor. A heating cable may commonly form part of a heating blanket. When part of a heating blanket the heating cable is typically arranged in coils or in a sinuous pattern throughout the blanket sandwiched between layers of material. An electrical current is passed through at least one conductor. The electrical current causes the conductor to heat up transferring the heat to the blanket and indirectly to the user, or the object to be heated.

Safety is a major issue for heating blankets, particularly with heating blankets that are used to warm for example bedding. The primary safety issue is that of over heating. Serious injury and some times death can occur, for example as a result of bedding catching fire due to the heating blanket over heating.

A secondary, but nevertheless significant issue is that of exposure of the user to an increased electromagnetic field (EMF). This arises as a result of a user being in close proximity to a conductor carrying an alternating current. It is becoming increasingly important to reduce the EMF emitted by consumer products both for health and product standard reasons. It is desirable that any controller arranged to reduce the risk of a heating cable over heating is also suitable for operation with a heating cable with a reduced EMF. To reduce the EMF emitted a dual heating element construction can be used which comprises two conductors. The two conductors are arranged such that current flows in opposite directions along the conductors. The effect of this is that the EMF emitted by one conductor is substantially or completely cancelled out by the EMF emitted by the other conductor. To achieve this opposite flow of current along the cable, each conductor is connected to a separate pole of a power supply at a first end of the cable, and the two conductors are joined together at the other end of the cable.

Many modern heating cables do not require separate thermostats in order to control their temperature. Such heating cables can be conveniently split into two categories. Firstly, there are those heating cables having a separation layer disposed between two conductors, the electrical resistance of the separation layer having a positive temperature coefficient (PTC). As the temperature of the cable increases, the resistance of the separation layer increases. Such a heating cable is self limiting as an increase in temperature leads to a decrease in current flow, and therefore reduced heating. Secondly, there are those heating cables that provide a feedback signal to a controller for monitoring the temperature of the cable. Embodiments of the present invention relate primarily to a controller for a heating cable falling into the second category.

Appliances incorporating heating cables are not always static in use. As a result folds can occur in the appliance and localised heating can arise due to an uneven distribution of the heating cable. For under floor heating, if part of the floor is covered an area of localised over heating can be created as it is more difficult for the generated heat to escape. It is known to have a heating cable wherein at least one conductor has a PTC characteristic such that as the resistance of the conductor increases with a rise in temperature. This resistance increase is detectable and the current supplied to the cable can be reduced accordingly. It is very difficult to detect a localised area of over heating with such a cable as a localised change in resistance will have a negligible effect on the overall measured resistance. For a heating cable with separate thermostat control it is unlikely that the thermostat would detect a localised area of heating unless the affected area is proximal to the thermostat.

Another known technique is to have a dual conductor construction with a fusible separation layer disposed between the two conductors. In the event of localised over heating the separation layer melts shorting out the cables. This leads to a large current flow, which is arranged to blow a fuse cutting off the power supply. While this solution works effectively, once the separation layer has melted the appliance is unusable. This is particularly undesirable when the cable is used in a hard to maintain location, such as is the case for under floor heating.

An early more sophisticated attempt to address the over heating issue is described in U.S. Pat. No. 3,375,477. This document describes a heating cable made up of a first conductor through which a heating current flows, and a second conductor, which extends alongside but is separated from the first conductor by a separation layer. The electrical resistance of the separation layer has a negative temperature coefficient (NTC) such that the resistance of the separation layer reduces with increasing temperature. For an area of localised heating the resistance of the separation layer in that area will reduce. The separation layer can be thought of as many parallel resistors along the length of the heating cable. Therefore a reduction in resistance in one area has a significant effect on the average resistance of the whole separation layer. Consequently the leakage current across the separation layer from the first conductor to the second conductor increases significantly. This leakage current can be detected and used to interrupt the supply of power to the first conductor in the event that the leaking current exceeds a predetermined threshold.

Generally a heating cable in accordance with U.S. Pat. No. 3,375,477 is supplied with a controller, which includes a circuit designed to cut off the supply of power if the current drawn by the heating element exceeds a predetermined threshold. Thus the overall assembly can be considered as a two-safety feature system. The NTC separation layer is designed so that the separation layer is not destroyed in the event of over heating and therefore the heating cable is not designed to be rendered permanently inoperable as a result of being subjected to an excess temperature on one occasion.

In a development of the basic concept of relying upon an NTC separation layer to detect over heating, it is known to use a separation layer which is both NTC and fusible. Such an arrangement is described in U.S. Pat. No. 6,310,332. In the described arrangement, normal power supply control is achieved by monitoring the NTC characteristics of the separation layer. If however abnormally high temperatures are reached at any point along the length of the heating cable the separation layer will melt, enabling the two conductors of the coaxial assembly to come into direct contact, thereby causing a short circuit between the two conductors. Such a short circuit can be detected and used to cut off the power supply. Once this has occurred the product is of course effectively destroyed as the product cannot be returned to a normal operative condition.

U.S. Pat. No. 6,310,332 describes two embodiments, that is the embodiment of FIG. 1 and the "more functional" embodiment of FIGS. 2 and 3 of that patent. In the embodiment of FIGS. 2 and 3, one conductor carries the heating current whereas the other is used for sensing purposes. The electrical resistance of the sensing conductor may also have a positive temperature coefficient (PTC) to provide an additional means for monitoring temperature along the length of the cable. With that arrangement, however, the EMF issue is not addressed as the sensing cable does not carry the heating current.

In contrast in the embodiment of FIG. 1 of U.S. Pat. No. 6,310,332, two heating wires are connected in series by a diode, with heating current passing through each of the heating wires. The diode means that only the positive half cycles of the AC supply can pass through the cable. During the negative half cycles the controller measures the leakage current through the separation layer, which bypasses the diode. Leakage of current through the separation layer is detected by the appearance of a current flowing in the opposite direction to the normal direction of current flow through the diode. This arrangement addresses the EMF issue as current in the two heating wires flows in opposite directions along the cable. However, only half the available power is used to heat the heating cable due to the presence of the diode. As such the resistance of the heating cable must be half that possible when the full AC cycle is used. This can create manufacturing problems, as cables become more inflexible as the resistance lowers.

It is desirable that a controller can be used in a range of products incorporating heating cables of different lengths.

It is an aim of embodiments of the present invention to obviate or mitigate one or more of the problems of the prior art, whether identified herein or elsewhere.

It is an aim of embodiments of the present invention to provide a new type of controller for a heating cable capable of detecting a change in temperature of a connected heating cable and adjusting the power supplied to the heating cable accordingly.

In preferred embodiments of the present invention the controller is arranged to prevent permanent damage being caused to either itself or the heating cable in the event of the cable over heating.

In preferred embodiments of the present invention the controller is arranged to measure two parameters of the heating cable to provide two independent forms of over heating protection. The two parameters are suitable for detecting over heating in a localised section of the heating cable and an average over heating along the whole length of the cable respectively.

It is an aim of embodiments of the present invention to provide a controller for a heating cable suitable for use with a cable that inherently has a good EMF performance.

It is a further aim of embodiments of the present invention to provide a controller for a heating cable capable of being used with heating cables of different lengths.

BRIEF SUMMARY OF THE INVENTION

According to a first aspect of the present invention there is provided a controller for a heating cable, the heating cable comprising at least first and second conductors and a separation layer interposed between said conductors, said conductors and the separation layer extending along the length of the cable, the electrical resistance provided by the separation layer between adjacent portions of said conductors having a negative temperature coefficient, the controller comprising: a first switch, arranged for connecting the first and second conductors electrically in series at one end of the cable such that if the first and second conductors are connected at the other end of the cable to respective poles of a power supply, currents flow in opposite directions through adjacent portions of the conductors; a second switch, arranged for connection in series between the first conductor and a pole of the power supply at the other end of the cable; a first resistor connected in parallel with the second switch; and voltage measurement means, arranged to measure the voltage across the first resistor, the voltage across the first resistor when both switches are open being responsive to changes in the electrical resistance of the separation layer; wherein the controller is arranged to control the supply of power to the cable as a function of the measured voltage across the first resistor when both switches are open.

Advantageously, such a controller can adjust the supply of power to the heating cable in response to changes in the resistance of the separation layer. This change in the resistance of the separation layer corresponds to a localised area of heating. Consequently, the controller can prevent dangerous local hot spots forming in an appliance incorporating a heating cable.

Preferably, the controller is arranged to reduce the power supplied to the cable in response to an increase in the measured voltage across the first resistor when both switches are open. The controller may be arranged to terminate the supply of power to the cable if the measured voltage across the first resistor when both switches are open exceeds a predetermined threshold.

The heating cable may further comprise a third conductor extending along the length of the cable and connected electrically in parallel to at least one of the first and second conductors.

At least one of said conductors of the heating cable may have a positive temperature coefficient of electrical resistance, and the controller may further comprise a second resistor, arranged for connection in series between at least one of said conductors and a pole of the power supply, and voltage measurement means arranged to measure the voltage across the second resistor, the voltage across the second resistor being responsive to changes in the resistance of at least one of said conductors, the controller being arranged to control the supply of power to the cable as a function of the measured voltage across the second resistor.

Preferably, the controller is arranged to reduce the power supplied to the cable in response to a decrease in the measured voltage across the second resistor. The controller may be arranged to terminate the supply of power to the cable if the measured voltage across the second resistor drops below a predetermined threshold.

The controller may further comprise a microprocessor arranged to receive the measured voltage across at least one of said resistors and arranged to control the supply of power to the cable in response to changes in said at least one measured voltage. The controller may further comprise a moving average filter arranged to provide a moving average of said at least one measured voltage, such that the microprocessor is arranged to control the supply of power to the cable in response to changes in the moving average of said at least one measured voltage. The microprocessor may be programmed with at least one temperature reference value for the measured voltage across at least one of said resistors at a predetermined temperature, the microprocessor being arranged to compare said at least one temperature reference value and the measured voltage across at least one of said resistors and supply power to the cable in response to a result of said comparison.

The controller may be programmed with a length reference value indicative of the voltage value across the second resistor when the conductor is connected to a predetermined length of cable at a predetermined temperature, the controller being arranged to compare said length reference value and the measured voltage across the second resistor and supply power to the cable in response to a result of said comparison. Preferably, the controller is arranged to measure the voltage across the second resistor once and store the measured voltage in a non-volatile memory when the controller is first connected to a length of cable, the controller being arranged to compare said length reference value and said stored measured voltage across the second resistor and supply power to the cable in response to a result of said comparison.

The heating cable may further comprise a third conductor extending along the length of the cable and the controller may further comprise a third resistor, connected in series with the third conductor, and voltage measurement means arranged to measure the voltage across the third resistor, and the controller is arranged to terminate the supply of power to the cable if the measured voltage across the third resistor rises above a predetermined threshold. Preferably, the predetermined threshold is zero volts.

According to a second aspect of the present invention there is provided a heating cable assembly comprising a controller as described above and a heating cable, wherein the heating cable comprises first and second conductors and a separation layer interposed between said conductors, said conductors and the separation layer extending along the length of the cable, the electrical resistance provided by the separation layer between adjacent portions of said conductors having a negative temperature coefficient.

According to a third aspect of the present invention there is provided a method of controlling a heating cable, the heating cable comprising at least first and second conductors and a separation layer interposed between said conductors, said conductors and the separation layer extending along the length of the cable, the electrical resistance provided by the separation layer between adjacent portions of said conductors having a negative temperature coefficient, the method comprising: measuring the voltage across a first resistor connected electrically in series between the first conductor at one end of the cable and a first pole of a power supply, with the second conductor connected at said end of the cable to a second pole of the power supply, the voltage across the first resistor being responsive to changes in the electrical resistance of the separation layer; and controlling the supply of power to the cable as a function of the measured voltage across the first resistor.

The heating cable may further comprise a third conductor extending along the length of the cable and connected electrically in parallel to at least one of the first and second conductors.

At least one of said conductors may have a positive temperature coefficient of electrical resistance, the method further comprising: measuring the voltage across a second resistor connected electrically between at least one of said conductors at one end of the cable and a pole of the power supply when the first and second conductors are connected electrically in series at the other end of the cable, the voltage across the second resistor being responsive to changes in the electrical resistance of said at least one conductor; and controlling the supply of power to the cable as a function of the measured voltage across the second resistor.

According to a fourth aspect of the present invention there is provided a method of manufacturing a controller for a heating cable, the heating cable comprising first and second conductors and a separation layer interposed between said conductors, said conductors and the separation layer extending along the length of the cable, the electrical resistance provided by the separation layer between adjacent portions of said conductors having a negative temperature coefficient, the method comprising providing: a first switch, arranged for connecting the first and second conductors electrically in series at one end of the cable such that if the first and second conductors are connected at the other end of the cable to respective poles of a power supply currents flow in opposite directions through adjacent portions of the conductors; a second switch, arranged for connection in series between the first conductor and a pole of the power supply at the other end of the cable; a first resistor connected in parallel with the second switch; and voltage measurement means, arranged to measure the voltage across the first resistor, the voltage across the first resistor when both switches are open being responsive to changes in the electrical resistance of the separation layer; wherein the controller is arranged to control the supply of power to the cable as a function of the measured voltage across the first resistor when both switches are open.

According to a fifth aspect of the present invention there is provided a controller for a heating cable, the heating cable comprising a first conductor, the controller comprising: a first resistor arranged for connection in series between the first conductor and a pole of the power supply; and voltage measurement means, arranged to measure the voltage across the first resistor; wherein the controller is programmed with a length reference value indicative of the voltage value across the first resistor when the conductor is connected to a predetermined length of cable at a predetermined temperature, the controller being arranged to compare said length reference value and the measured voltage across the first resistor and supply power to the cable in response to a result of said comparison.

Advantageously, such a controller can be used to control different heating cables with a common heating cable construction. The resistance per metre of the heating cable incorporated in the product is standardised, but the length may vary for a number of appliances. This leads to efficiency savings as the heating cable may be manufactured in bulk quantities, which reduces the overall manufacturing cost of the cable. Furthermore, only having to manufacture a single type of controller allows this item to be produced in larger quantities, which also provides cost savings. The above controller has these advantages as the controller can determine the overall resistance of the heating cable that it is connected to, and deliver the correct amount of power.

The controller may be arranged to measure the voltage across the first resistor once and store the measured voltage in a non-volatile memory when the controller is first connected to a length of cable, the controller being arranged to compare said length reference value and said stored measured voltage across the first resistor and supply power to the cable in response to a result of said comparison.

The heating cable may further comprise a second conductor and a separation layer interposed between said first and second conductors, said conductors and the separation layer extending along the length of the cable, the separation layer being arranged to melt if heated to a predetermined threshold temperature and the second conductor being arranged to conduct current from the first conductor in the event of the separation layer melting, and the controller further comprises a second resistor, connected in series with the second conductor, and voltage measurement means arranged to measure the voltage across the second resistor, and the controller may be arranged to terminate the supply of power to the cable if the measured voltage across the second resistor rises above a predetermined threshold. Preferably, the predetermined threshold is zero volts.

According to a sixth aspect of the present invention there is provided a method of controlling a heating cable, the heating cable comprising a first conductor, the method comprising: measuring the voltage across a first resistor connected in series between the first conductor at one end of the cable and a first pole of a power supply, with the other end of said conductor connected to a second pole of the power supply; comparing the measured voltage across the first resistor with a length reference value indicative of a voltage value across the first resistor when the conductor is connected to a predetermined length of cable at a predetermined temperature; and controlling the supply of power to the cable in response to a result of said comparison.

BRIEF DESCRIPTION OF THE DRAWINGS

Embodiments of the present invention will now be described, by way of example, with reference to the accompanying drawings, in which.

DETAILED DESCRIPTION OF THE INVENTION

Figure 1:
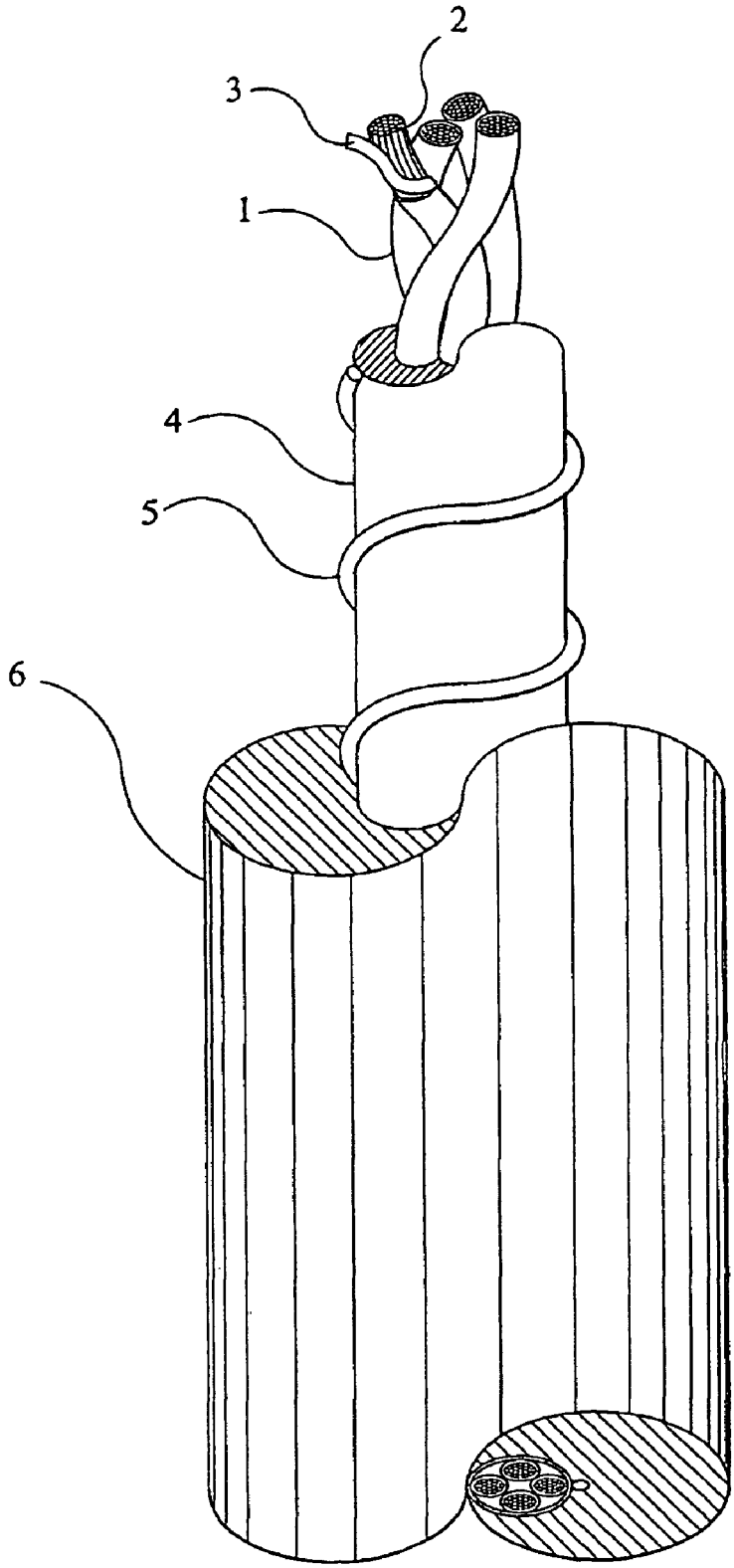
FIG. 1 illustrates the physical structure of a heating cable suitable for operation with a controller in accordance with the present invention.

Referring to FIG. 1, this illustrates the structure of a dual construction heating cable suitable for operation with a controller in accordance with embodiments of the present invention. The structure of this cable is disclosed in unpublished PCT patent application number PCT/GB2004/003054. The cable comprises a central first conductor 1 in the form of a twisted together bundle of four components. Each component comprises a central fibre core 2 which provides mechanical strength and which is wrapped by a helically extending wire 3. This type of construction is known as a tinsel cable. The first conductor 1 has a separation layer 4 extruded onto it and a second conductor 5 is wound onto the separation layer 4 to form a helix. An extruded jacket 6 of waterproof and electrically insulating material completes the cable assembly.

Figure 2:
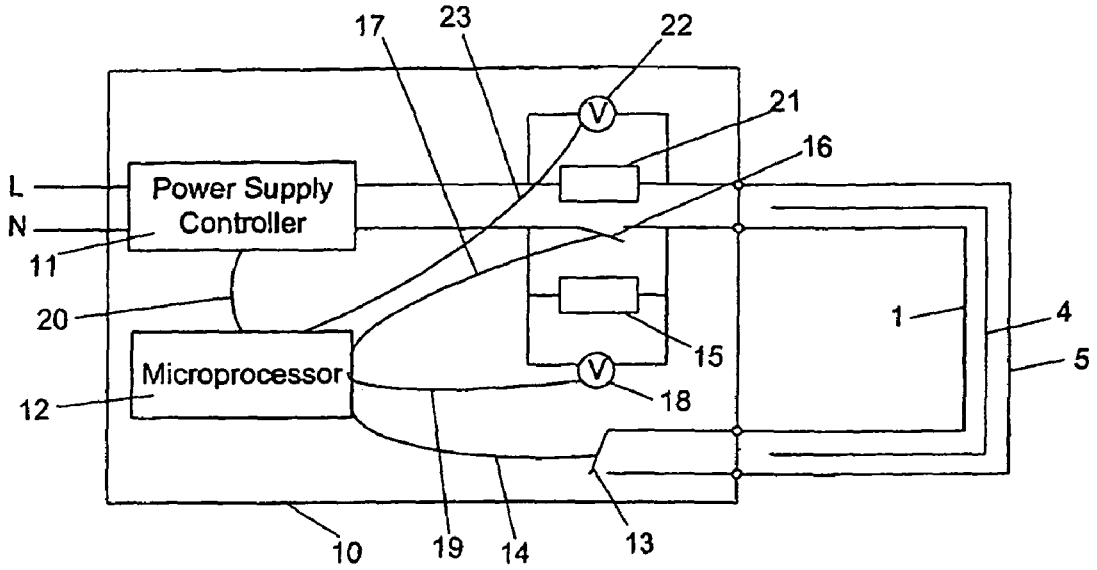
FIG. 2 illustrates a controller in accordance with an embodiment of the present invention arranged to control the supply of power to a heating cable.

As discussed above in the preamble, in order to achieve a: low EMF, the two conductors of a dual conductor heating cable are connected together at one end of the cable. Referring to FIG. 2, this schematically represents a circuit comprising a controller 10 in accordance with the a preferred embodiment of the present invention and a heating cable, which may be a heating cable such as that illustrated in FIG. 1. The separation layer 4 is manufactured from a material that has an electrical resistance having a negative temperature coefficient (NTC). As a result, as the temperature increases at any location along the length of the cable, the local resistance of the separation layer 4 decreases. Due to this local reduction in resistance the current leaking through the separation layer 4 in that area increases. This leakage current is used as one of the control parameters of the cable.

The controller 10 comprises a power controller 11, which varies the current supplied to the first and second conductors 1, 5 from the live L and neutral N terminals of a power supply. The controller 10 further comprises a microprocessor 12, the operation of which is described below.

In order to measure the change in resistance of the separation layer it is necessary to temporarily break the electrical connection between the two conductors 1, 5. This is achieved by opening a switch 13 between the first and second conductors 1, 5 at one end of the cable. The opening and closing of switch 13 (at the desired times) is controlled by the microprocessor 12 via control line 14.

To measure the voltage across the separation layer 4, and thereby calculate the resistance of the separation layer 4 (as the current supplied by the power controller 11 is known) a potential divider is created. One resistor of the potential divider is the separation layer 4 itself. A second resistor is a fixed resistor. The resistance of the second resistor is ideally comparable to the resistance of the separation layer in order to ensure the maximum possible voltage variation across the fixed resistor. The fixed resistor is resistor 15, which in series with the first conductor. As resistor 15 has a large resistance it is necessary to bypass resistor 15 when current is flowing through the two conductors 1, 5 for heating. This bypass is achieved by putting resistor 15 in parallel with a switch 16. The timing of the opening and closing of switch 16 is controlled by the microprocessor 12 via control line 17.

The voltage across resistor 15 is measured using voltmeter 18, and this measurement is passed to microprocessor 12 via control line 19.

When the heating cable is being used for heating, switches 13 and 16 are closed so that resistor 15 is bypassed. Current from power supply controller 11 passes through both conductors 1, 5. To measure the resistance of the NTC separation layer 4 both switches 13, 16 are opened and the voltage across resistor 15 is measured. The measured voltage value is passed to microprocessor 12. Microprocessor 12 calculates the resistance of the separation layer 4, and thereby can determine the temperature of the separation layer 4. The microprocessor 12 uses this temperature value to vary the power supplied to the heating cable by power supply controller 11, by passing a signal on control line 20.

In order to reduce the temperature of the heating cable, microprocessor 12 can be arranged to reduce the power supplied to the heating cable in response to a increase in the measured voltage across resistor 15. The microprocessor 12 may be arranged to terminate the supply of power to the heating cable, if the voltage across resistor 15 exceeds a predetermined threshold.

A second form of temperature control can be achieved if at least one of the first or second conductors 1, 5 is arranged to have a resistance with a positive temperature coefficient (PTC) characteristic. This gives an accurate measure of the average temperature of the heating cable. Additionally, by having a second form of temperature control if one control fails or incorrectly calculates the temperature, the other control can prevent over heating.

The resistance of the PTC conductors may be measured in a similar manner to measuring the resistance of the NTC separation layer, i.e. by setting up a potential divider between the conductors and a resistor 21. Resistor 21 is shown in series between the power supply controller 11 and the second conductor 5. The voltage across resistor 21 is measured by voltmeter 22 and supplied to the microprocessor 12 via control line 23. Resistor 21 is arranged to be a low resistance resistor such that it is not necessary to bypass resistor 21 during heating of the heating cable. However, resistor 21 could be placed in parallel with a switch to temporarily bypass the resistor, in a similar arrangement to resistor 15 and switch 16.

Alternatively, the voltage across resistor 15 could be used to measure the resistance of the PTC conductors when switch 16 is open and switch 13 is closed. This allows only a single resistor to be used by measuring the resistance of the NTC separation layer and the PTC conductors at separate times.

The calculation of the average resistance of the conductors is normally carried out when switches 13 and 16 are closed. To measure the resistance of the PTC conductors 1, 5 the voltage across resistor 21 is measured and passed to microprocessor 12 via control line 23. Microprocessor 12 calculates the resistance of the conductors, and can therefore determine the average temperature of the heating cable. Microprocessor 12 uses this temperature value to vary the power supplied to the heating cable by power supply controller 11, via control line 20.

In order to reduce the temperature of the heating cable, microprocessor 12 can be arranged to reduce the power supplied to the heating cable in response to a decrease in the measured voltage across resistor 21. Microprocessor 12 can be arranged to terminate the supply of power to the heating cable if the voltage across resistor 21 drops below a predetermined threshold.

By using microprocessor 12 the controller 10 is able to make some intelligent assumptions about the state of the heating cable. For example, if the temperature coefficient of the conductors is low along with a low overall resistance then the change in resistance of the conductors over the operating range of temperatures may be low. This means that errors may arise in the calculation of the average temperature of the heating cable. Conversely, the change in resistance of the separation layer may be relatively great and can therefore be more easily measured. The microprocessor can track the change in the resistance of the separation layer and deduce whether the heating cable is getting hotter or colder and the rate that this is occurring. If due to a spurious measurement the resistance of the conductors does not correspond to the expected result then the result can be ignored.

In order to further increase the accuracy of the temperature measurements a moving average filter may be incorporated into the controller 10, most typically implemented by the microprocessor. It commonly takes at least a few minutes for the temperature of a heating cable to change appreciably, e.g. for a change of 10° C. A number of previous readings of the voltages across either resistor 15 or 21 (or both) are stored within the controller 10 and an average of these readings is calculated. This gives a more accurate temperature calculation. Each time a new measurement is obtained (at a sampling rate set by the microprocessor 12) the oldest reading is deleted and the new reading stored.

In order for the controller 10 to accurately calculate the temperature of the heating cable, the PTC characteristics of the conductors 1, 5 and the NTC characteristics of the separation layer 4 must be known. Due to manufacturing tolerances these may not be accurately known leading to a potentially serious source of error. This source of error may be removed by arranging for the microprocessor 12 to store a temperature reference value for the voltage across resistor 15 and/or resistor 21 at a predetermined temperature. The or each temperature reference value may be stored in non-volatile memory within the microprocessor. The temperature reference values are specific to each combination of controller and heating cable. The temperature reference values can then be used by microprocessor 12 to adjust the calculated temperature of the heating cable by comparing the stored temperature reference value with the measured voltage across each resistor. The use of a non-volatile memory ensures that the reference measurement only needs to be performed once. This may be done during manufacturing of a heating appliance comprising a controller as described herein and a heating cable by the manufacturer connecting the controller and the heating cable together in a controlled temperature environment and briefly switching the appliance on. Alternatively, if for the particular materials used the PTC/NTC characteristics of the heating cable are accurately known then this manufacturing step may be dispensed with. Temperature reference values may simply be programmed into the controller 10 during manufacturing.

In an alternative embodiment of the present invention, the heating cable may further comprise a third conductor. The third conductor may have a highly PTC characteristic and be arranged in parallel to at least one of the first and second conductors. Resistor 21 may be placed in series with the third conductor to measure the change in resistance of the third conductor in order to calculate the average temperature of the heating cable. The third conductor may have a high overall resistance as the third conductor is not required to dissipate any power. The heating current will continue to mainly pass through the first and second conductors. This means that the high resistance of the third conductor will not affect the efficiency of the heating cable. The advantage of using a third conductor is that for a given increase in temperature there is a much increased change in resistance. The increased change in resistance improves the accuracy of the PTC temperature measurement, and therefore the reliability of the controller.

Alternatively, the third conductor may be electrically isolated from the first and second conductors. The separation layer may be arranged to be fusible, such that if the temperature exceeds a predetermined threshold temperature current flows to the third conductor and back to the controller. This current can be detected, most simply by having a resistor in series with the third conductor and detecting any voltage across the resistor. The flow of current along the third conductor is used to terminate the supply of power to the heating cable.

In an alternative embodiment of the present invention a controller for a heating cable may be arranged to adjust the power supplied to a heating cable in response to the length of the cable connected to the controller. This type of control can be incorporated into the over heat protection controller described above. Additionally, the controller may be arranged to adjust the power supplied to the heating cable in response to a user entered desired power level. For example a double sized electric blanket may have 30 m of cable running within it. Using a 120 Vac supply the maximum desired power output may be 120 W, giving a nominal current rating of 1 A. A second lower heat setting may be desirable, for instance 80 W. For an 60 Hz AC supply the lower average power setting may be achieved by removing every third AC cycle. The heating cable is therefore supplied with 40 cycles per second of AC current. In effect, for two thirds of the time the blanket is running at 120 W, and for the other third of the time the blanket is switched off, giving a reduced average power setting. It may be seen that using this technique of selectively removing power cycles any average power setting may be chosen.

As discussed in the preamble, it is desirable to use a standard type of controller with heating cables of varying length in a range of appliances. In order to ensure that the power output is controlled effectively it is necessary for the controller to determine the overall resistance of the heating cable that the controller is connected to. For the electric blanket example, if the length of the same type of wire is now only 15 m (corresponding to a single sized electric blanket) twice the current will flow. Consequently the maximum power output will now be 240 W. To maintain the maximum power output of the blanket at 120 W every second AC cycle must be removed. The number of cycles per second can be calculated as follows:

$$\text{Number_cycles} = \frac{\text{Desire_power}}{\text{Maximum_power}} * 60 = \frac{120}{240} * 60 = 30$$

As before, various lower heat settings may be set by further reducing the number of cycles per second. For instance, to give an average power setting of 80 W the number of cycles per second should be (⅔)*30=20 cycles per second.

If the double sized electric blanket has a heating cable resistance rating of $4\Omega m^{-1}$ then the total resistance of the electric blanket is 120Ω. Using the same type of cable, the total resistance of the single electric blanket is 60Ω. Therefore, in order for the controller to be able to adjust the power supplied to the heating cable according to the length of connected cable the resistance of the heating cable must first be measured. The correct number of cycles to deliver to the heating cable for each power setting may then be calculated.

When a heating cable is first switched on it can be desirable to allow the cable to warm up to the required temperature as rapidly as possible. This can be achieved by using a cable with a higher power rating than would normally be specified. For example, for the above double sized electric blanket, at the highest user setting of 120 W the power per metre is 120/30=4 $Wm^{-1}$. During initial warm-up this can be increased, for example to 8 $Wm^{-1}$ to reduce the amount of time this takes. As the voltage supply is fixed, in order to double the power output per metre the resistance rating of the cable must be reduced by a factor of 2. Once the cable has reached the required temperature, the power supplied to the cable is reduced as described above to the normal maximum power output level, or the user setting if lower.

Additional temperature control of the heating cable, can be achieved by further reducing or increasing the number of cycles per second of power supplied to the cable in the same way. Alternatively, a controller can have no separate over temperature control. Such an appliance would be most suited to applications where the risk of over heating is minimal.

The controller determines the resistance of the heating cable by measuring the voltage across a low resistance resistor in series with a conductor of the heating cable. When combined with the type of controller depicted in FIG. 2 this resistor may be resistor 21. Alternatively, a separate resistor and voltmeter may be provided. The resistance of the resistor is known and fixed. A length reference value voltage across the resistor may be programmed into the controller for a known standard length of heating cable at a predetermined temperature. The voltage across the resistor when the controller is connected to a different length of heating cable may be measured. From a comparison of the two measurements the length of heating cable currently connected may be determined, and the power supplied to the heating cable adjusted accordingly. The length reference value and the measured voltage across the resistor may be stored in non-volatile memory, such that the measurement of the voltage across the resistor for the currently connected heating cable need only be performed once when the cable is first connected. This is desirable, as the resistance of the heating cable is liable to change as the heating cable heats up. Alternatively, the measured voltage across the resistor may be continuously or intermittently measured and compared to the length reference value.

Given that the controller is operative to monitor the end-to-end resistance of the PTC first and/or second conductor 1, 5 and is also operative to monitor the magnitude of current leaking through the separation layer 4 the two over heat control systems are essentially independent A manufacturing error that made one of the sensing systems ineffective, for example errors in the thickness or the constitution of the separation layer 4, would not render the other sensing system ineffective. Furthermore, monitoring of the leakage current through the separation layer 4 is sensitive to any leakage current even if all of the leakage current occurs in a very localised portion of the cable. The controller is therefore highly sensitive to the development of localised hot spots.

With regard to the EMF issue, given that power is supplied only to one end of the cable, and that the first and second conductors 1, 5 are connected in series at any point along the length of the cable substantially identical and opposite currents pass through adjacent portions of the first and second 1, 5. As a result there is substantially no EMF emitted from the cable.

As an alternative, the separation layer 4 can be fabricated from a fusible material, which will melt if the local temperature exceeds a predetermined threshold. When such melting occurs, given that the second conductor 5 is wound around the separation layer 4, the first and second conductors 1, 5 will come into contact and effectively short out the cable.

The switches 13 and 16 may be any form of controlled switch known in the art, such as a triac or a transistor. Alternatively, the switches may be diacs, such that the switches are not controlled by a separate control line, rather they are arranged to conduct current when the voltage across the switch exceeds a breakover voltage. This removes the need for a separate triggering circuit.

It will be appreciated that resistors 15 and 21 may be in series with either the first conductor 1 or the second conductor 5 as the current travels along both conductors.

Although the various measurement and control steps have been described above as having been carried out by a microprocessor 12 it will be appreciated that they may be performed by other means known in the art such as discrete circuitry or in software. The microprocessor 12 may be integrated with the other components of the controller 10 such as the power supply controller 11. The whole controller 10 may be integrated into a single microprocessor.

FIG. 2 depicts the controller having two separate voltmeters 18 and 22. Alternatively the controller may have a single voltmeter together with appropriate switching circuitry arranged such that the voltmeter may read the voltage across resistors 15 and 21 at separate times.

The first conductor may be connected to the live pole of the power supply and the second conductor may be connected to the neutral pole. It will be appreciated that the poles of the power supply may be reversed.

The timing of the voltage measurements may vary. The timing may be controlled by the microprocessor. As it may take several minutes for a significant change in temperature of the heating cable to occur the voltage measurements need not be made very frequently. The measurement of the voltage across resistor 15 may be arranged to be carried out during a period when power is not supplied for heating purposes. As resistor 21 is in series with the conductors then the voltage across this resistor may be measured at any point without interrupting the heating cycle.

In the embodiment of the present invention relating to adjusting the power supplied to a heating cable in response to the length of the heating cable, the heating cable may be of any type having at least one conductor, the resistance of which varies according to the length of the conductor. The conductor may be of the type described in relation to FIG. 1. The conductor may include at least one further conductor electrically isolated from the first conductor and a fusible separation layer between the two conductors. In the event of the temperature exceeding a predetermined threshold temperature and the separation layer melting the further conductor is arranged to come into contact with the first conductor to conduct electricity back to the controller. This current can be detected by measuring the voltage across a resistor in series with the further conductor and terminating the supply of power to the heating cable if the voltage exceeds a predetermined threshold. The predetermined threshold is typically zero volts.

The term heating cable is used herein in a broad sense to refer to any cable that is arranged to heat up when electrical current is passed through it. The heating cable may form part of a heating blanket for example an under blanket (typically placed beneath a sheet on a bed) or an over blanket (typically draped over a sleeping person). Alternatively, the heating cable may form part of a heating pad (a relatively small article which may be applied by a user to a particular part of the users body) or the like. However, a controller as described herein may be used in the control of all other flexible heating element appliances known in the art such as under floor heating, pipe trace heating cable and under carpet heating.

Further modifications and applications of embodiments of the present invention will be readily apparent to the appropriately skilled person.

The invention claimed is:

1. A controller for a heating cable, the heating cable comprising at least first and second conductors and a separation layer interposed between said first and second conductors, said first and second conductors and the separation layer extending along the length of the heating cable, the electrical resistance provided by the separation layer between adjacent portions of said first and second conductors having a negative temperature coefficient, the controller comprising:

a first switch, arranged for connecting the first and second conductors electrically in series at one end of the heating cable such that if the first and second conductors are connected at the other end of the heating cable to respective poles of a power supply, currents flow in opposite directions through adjacent portions of the conductors;

a second switch, arranged for connection in series between the first conductor and a pole of the power supply at the other end of the heating cable;

a first resistor connected in parallel with the second switch; and voltage measurement means, arranged to measure voltage across the first resistor, the voltage across the first resistor when both switches are open being responsive to changes in the electrical resistance of the separation layer;

wherein the controller is arranged to control the supply of power to the heating cable as a function of the measured voltage across the first resistor when both switches are open.

2. A controller according to claim 1, wherein the controller is arranged to reduce the power supplied to the heating cable in response to an increase in the measured voltage across the first resistor when both switches are open.

3. A controller according to claim 1, wherein the controller is arranged to terminate the supply of power to the heating cable if the measured voltage across the first resistor when both switches are open exceeds a predetermined threshold.

4. A controller according to claim 1, wherein the heating cable further comprises a third conductor extending along the length of the heating cable and connected electrically in parallel to at least one of the first and second conductors.

5. A controller according to claim 1, wherein at least one of said first and second conductors of the heating cable has a positive temperature coefficient of electrical resistance, and the controller further comprises a second resistor, arranged for connection in series between at least one of said first and second conductors and a pole of the power supply, and voltage measurement means arranged to measure voltage across the second resistor, the voltage across the second resistor being responsive to changes in the resistance of at least one of said first and second conductors, the controller being arranged to control the supply of power to the heating cable as a function of the measured voltage across the second resistor.

6. A controller according to claim 5, wherein the controller is arranged to reduce the power supplied to the heating cable in response to a decrease in the measured voltage across the second resistor.

7. A controller according to claim 5, wherein the controller is arranged to terminate the supply of power to the heating cable if the measured voltage across the second resistor drops below a predetermined threshold.

8. A controller according to claim 1, further comprising a microprocessor arranged to receive the measured voltage across at least one of said resistors and arranged to control the supply of power to the heating cable in response to changes in said measured voltage.

9. A controller according to claim 8, further comprising a moving average filter arranged to provide a moving average of said at least one measured voltage, such that the microprocessor is arranged to control the supply of power to the heating cable in response to changes in the moving average of said measured voltage.

10. A controller according to claim 8, wherein the microprocessor is programmed with at least one temperature reference value for the measured voltage across at least one of said resistors at a predetermined temperature, the microprocessor being arranged to compare said at least one temperature reference value and the measured voltage across at least one of said resistors and supply power to the heating cable in response to a result of said comparison.

11. A controller according to claim 5, wherein the controller is programmed with a length reference value indicative of the voltage value across the second resistor when the conductor is connected to a predetermined length of cable at a predetermined temperature, the controller being arranged to compare said length reference value and the measured voltage across the second resistor and supply power to the heating cable in response to a result of said comparison.

12. A controller according to claim 11, wherein the controller is arranged to measure voltage across the second resistor once and store the measured voltage in a non-volatile memory when the controller is first connected to a length of cable, the controller being arranged to compare said length reference value and said stored measured voltage across the second resistor and supply power to the heating cable in response to a result of said comparison.

13. A controller according to claim 1, wherein the heating cable further comprises a third conductor extending along the length of the heating cable and the controller further comprises a third resistor, connected in series with the third conductor, and voltage measurement means arranged to measure voltage across the third resistor, and the controller is arranged to terminate the supply of power to the heating cable if the measured voltage across the third resistor rises above a predetermined threshold.

14. A controller according to claim 13, wherein the predetermined threshold is zero volts.

15. A controller according to claim 1, the controller configured to be employed in a heating cable assembly with the heating cable.

16. A method of controlling a heating cable, the heating cable comprising at least first and second conductors and a separation layer interposed between said first and second conductors, said first and second conductors and the separation layer extending along the length of the heating cable, the electrical resistance provided by the separation layer between adjacent portions of said first and second conductors having a negative temperature coefficient, the method comprising:

coupling the first and second conductors at a first end of the heating cable to respective poles of a power supply;

coupling a first switch between the first and second conductors at a second end of the heating cable to connect the conductors electrically in series such that when the first switch is closed current can flow in opposite directions through adjacent portions of the conductors;

coupling a second switch in series between the first conductor and a pole of the power supply at the first end of the heating cable;

opening the first switch;

opening the second switch;

measuring the voltage across a first resistor connected electrically in parallel with the second switch; and controlling the supply of power to the heating cable as a function of the measured voltage across the first resistor when both switches are open.

17. A method according to claim 16, wherein the heating cable further comprises a third conductor extending along the length of the heating cable and connected electrically in parallel to at least one of the first and second conductors.

18. A method according to claim 16, wherein at least one of said first and second conductors has a positive temperature coefficient of electrical resistance, the method further comprising:

measuring the voltage across a second resistor connected electrically between at least one of said first and second conductors at one end of the heating cable and a pole of the power supply when the first and second conductors are connected electrically in series at the other end of the heating cable, the voltage across the second resistor being responsive to changes in the electrical resistance of said at least one conductor; and controlling the supply of power to the heating cable as a function of the measured voltage across the second resistor.

19. A method of manufacturing a controller for a heating cable, the heating cable comprising first and second conductors and a separation layer interposed between said first and second conductors, said first and second conductors and the separation layer extending along the length of the heating cable, the electrical resistance provided by the separation layer between adjacent portions of said first and second conductors having a negative temperature coefficient, the method comprising providing:

a first switch, arranged for connecting the first and second conductors electrically in series at one end of the heating cable such that if the first and second conductors are connected at the other end of the heating cable to respective poles of a power supply currents flow in opposite directions through adjacent portions of the conductors;

a second switch, arranged for connection in series between the first conductor and a pole of the power supply at the other end of the heating cable;

a first resistor connected in parallel with the second switch; and voltage measurement means, arranged to measure voltage across the first resistor, the voltage across the first resistor when both switches are open being responsive to changes in the electrical resistance of the separation layer;

wherein the controller is arranged to control the supply of power to the heating cable as a function of the measured voltage across the first resistor when both switches are open.

20. A controller for a heating cable, the heating cable comprising a first conductor, the controller comprising:

a first resistor arranged for connection in series between the first conductor and a pole of a power supply; and voltage measurement means, arranged to measure voltage across the first resistor;

wherein the controller is programmed with a length reference value indicative of a reference voltage value across the first resistor when the conductor is connected to a predetermined length of cable at a predetermined temperature, the controller being arranged to compare said length reference value against the measured voltage across the first resistor and supply power to the heating cable in response to a result of said comparison.

21. A controller according to claim 20, wherein the controller is arranged to measure voltage across the first resistor once and store the measured voltage in a non-volatile memory when the controller is first connected to a length of cable, the controller being arranged to compare said length reference value and said stored measured voltage across the first resistor and supply power to the heating cable in response to a result of said comparison.

22. A controller according to claim 20, wherein the heating cable further comprises a second conductor and a separation layer interposed between said first and second conductors, said first and second conductors and the separation layer extending along the length of the heating cable, the separation layer being arranged to melt if heated to a predetermined threshold temperature and the second conductor being arranged to conduct current from the first conductor in the event of the separation layer melting, and the controller further comprises a second resistor, connected in series with the second conductor, and voltage measurement means arranged to measure voltage across the second resistor, and the controller is arranged to terminate the supply of power to the heating cable if the measured voltage across the second resistor rises above a predetermined threshold.

23. A controller according to claim 22, wherein the predetermined threshold is zero volts.

24. A method of controlling a heating cable, the heating cable comprising a first conductor, the method comprising:

measuring voltage across a first resistor connected in series between the first conductor at one end of the heating cable and a first pole of a power supply, with the other end of said first conductor connected to a second pole of the power supply;

comparing the measured voltage across the first resistor against a length reference value indicative of a reference voltage value across the first resistor when the conductor is connected to a predetermined length of cable at a predetermined temperature; and controlling the supply of power to the heating cable in response to a result of said comparison.

* * * * *